US011046069B2

(12) United States Patent
Xu et al.

(10) Patent No.: US 11,046,069 B2
(45) Date of Patent: Jun. 29, 2021

(54) WHEEL LOGO IMPRINTING DEVICE

(71) Applicant: CITIC Dicastal CO., LTD., Hebei (CN)

(72) Inventors: Zuo Xu, Qinhuangdao (CN); Guoyuan Xiong, Qinhuangdao (CN); Huiying Liu, Qinhuangdao (CN); Sheng Zhang, Qinhuangdao (CN)

(73) Assignee: CITIC DICASTAL CO., LTD, Qinhuangdao (CN)

( * ) Notice: Subject to any disclaimer, the term of this patent is extended or adjusted under 35 U.S.C. 154(b) by 254 days.

(21) Appl. No.: 16/257,180

(22) Filed: Jan. 25, 2019

(65) Prior Publication Data

US 2019/0358980 A1 Nov. 28, 2019

(30) Foreign Application Priority Data

May 24, 2018 (CN) ..... 201810504933.2

(51) Int. Cl.

| | |
|---|---|
| ***B41F 17/14*** | (2006.01) |
| ***B41F 17/16*** | (2006.01) |
| ***B41L 19/00*** | (2006.01) |
| ***B41K 3/04*** | (2006.01) |
| ***B41F 17/00*** | (2006.01) |
| ***B41F 23/04*** | (2006.01) |

(52) U.S. Cl.

CPC ..... *B41F 17/14* (2013.01); *B41F 17/006* (2013.01); *B41F 23/04* (2013.01); *B41K 3/04* (2013.01); *B41L 19/00* (2013.01); *B41P 2213/90* (2013.01); *B41P 2217/50* (2013.01)

(58) Field of Classification Search

CPC ..... B41F 17/14; B41F 17/16; B41F 17/006; B41K 3/04

USPC ..... 101/44

See application file for complete search history.

(56) References Cited

U.S. PATENT DOCUMENTS

2016/0236459 A1* 8/2016 Xue ..... B41F 17/001
2019/0022997 A1* 1/2019 Liu ..... B41F 17/08

* cited by examiner

*Primary Examiner* — Leslie J Evanisko
(74) *Attorney, Agent, or Firm* — Cooper Legal Group, LLC

(57) ABSTRACT

A wheel logo imprinting device includes a wheel feeding system, a position identification system, a wheel turning system, a logo imprinting system, a station switching system, a logo drying system and a wheel discharging system. The device can be used for continuous production of assembly lines, can realize multi-directional, multi-angle and multi-number imprinting of personalized logos, orderly connects feeding, imprinting, drying and discharging through a reasonable process layout, and integrates imprinting and drying by using double stations so as to greatly improve the production efficiency and shorten the production cycle.

1 Claim, 4 Drawing Sheets

WHEEL LOGO IMPRINTING DEVICE

CROSS-REFERENCE TO RELATED APPLICATION

The present application claims benefit of Chinese Patent Application No. 201810504933.2, filed on May 24, 2018, the contents of which are hereby incorporated by reference in its entirety.

BACKGROUND

With the popularity of aluminum alloy hubs, more customers pursue individualization and aesthetics. After the hub coating is completed, many customers require that the front rims, spokes or window edges of wheels are imprinted with iconic logos, and that one or more logos are arranged on one circle of the wheel. At present, when a logo is manually imprinted, the position is not easy to control, the precision is low, and the attractiveness is poor due to the lacking of special equipment for imprinting a logo on the front side of a wheel. High temperature baking is required after the logo is imprinted to dry the paint. According to the process characteristics, manual imprinting is performed first and then baking in an oven is performed, so the efficiency is low, and the automatic production of the assembly line cannot be realized.

SUMMARY

The present disclosure relates to the field of imprinting technology, specifically to a device for imprinting a logo on the front side of a wheel. The objective of the present disclosure is to provide a wheel logo imprinting device, which can be used for continuous production of assembly lines, can realize multi-directional, multi-angle and multi-number imprinting of personalized logos, orderly connects feeding, imprinting, drying and discharging through a reasonable process layout, and integrates imprinting and drying by using double stations so as to greatly improve the production efficiency and shorten the production cycle.

In order to achieve the above objective, the technical solution of the present disclosure lies in a wheel logo imprinting device, including a frame, a first jacking cylinder, first feed guide pillars, a first support frame, a guide sleeve, a first feed platform, an air pump, a first positioning column, guide rails, a gear rack, a left sliding table, a right sliding table, a clamping cylinder, positioning shafts, positioning wheels, a support frame, a first servo motor, a bearing seat, a bearing, a shaft, a rotary table, a second servo motor, a third servo motor, a first manipulator, a second manipulator, roller driven motors, rollers, first upper cylinders, first upper guide pillars, a first upper platform, a visual identifier, second upper cylinders, second upper guide pillars, a second upper platform, a side cylinder, side guide rails, a side platform, a feed cylinder, second feed guide pillars, a second feed platform, a paint supply tank, an elastic pressure head, a third upper cylinder, third upper guide pillars, an oven rack, oven heat sources, fourth upper cylinders, fourth upper guide pillars, sleeves, shields, a second jacking cylinder, discharge guide pillars, a second support frame, a discharge platform and a second positioning column.

The wheel logo imprinting device includes a wheel feeding system, a position identification system, a wheel turning system, a logo imprinting system, a station switching system, a logo drying system and a wheel discharging system. The respective systems coordinate to connect feeding, imprinting, drying and discharging of wheels orderly and reciprocally for continuous production.

The guide rails are symmetrically mounted on the first support frame, the left sliding table and the right sliding table are symmetrically mounted on the guide rails and connected by the gear rack, the output end of the clamping cylinder is connected to the right sliding table, and the four positioning wheels are mounted on the left sliding table and the right sliding table via the positioning shafts. The output end of the first jacking cylinder is connected to the first feed platform. Under the guidance of the first feed guide pillars, the first jacking cylinder controls the first feed platform to move up and down. The first positioning column is mounted on the upper end surface of the first feed platform to prevent a wheel from deviating during ascending, the air pump is mounted inside the first feed platform to output compressed air, and the compressed air is blown out from the upper end surface of the first feed platform to dry the flange surface of the wheel so as to improve the positioning stability of the wheel. After the wheel enters a roller bed, the clamping cylinder is started, the left sliding table and the right sliding table move synchronously under the action of the gear rack, the wheel can be initially positioned by the four positioning wheels, and then the positioning wheels are reset; next, the first jacking cylinder is started to drive the first feed platform to ascend, and the air pump is opened to provide compressed air to the flange surface of the wheel; when the first feed platform contacts the flange surface of the wheel, the first positioning column is inserted into the center hole of the wheel, the air pump is closed, the first feed platform continues to ascend to jack the wheel to a predetermined height, the first manipulator located above the wheel can clamp the wheel through the four rollers, and then the first feed platform is re reset. This is the wheel feeding system, and the wheel is conveyed from the roller bed to be clamped by the manipulator.

The first upper cylinders are fixedly mounted on the frame directly above the wheel and controls the first upper platform to move up and down under the guidance of the first upper guide pillars, the visual identifier is mounted on the first upper platform, and the first upper cylinders drive the first upper platform to move up and down to adjust the visual detection accuracy of the visual identifier. After the manipulator clamps the wheel, the roller driven motors can drive the rollers to rotate so as to drive the wheel to rotate at a low speed, and an imprinting position in the circumferential direction can be accurately found by the detection of the visual identifier. After the imprinting position is found, the wheel stops rotating. After one logo is imprinted, the imprinting system is retracted, the wheel can continue to rotate, and next imprinting position is searched through the visual identifier, thereby realizing multi-position and multi-number imprinting of personalized logos in the circumferential direction of the wheel. This is the position identification system.

The second servo motor is fixed on the rotary table, and its output end is connected to the first manipulator to control the turning of the manipulator, thereby controlling the turning of the wheel. The front spokes, rim and window of the wheel have certain arc angles. When a logo is imprinted, the elastic pressure head needs to be perpendicular to the imprinted surface, so the wheel needs to be turned over. The second servo motor can control the wheel to turn over at any angle, so that the elastic pressure head is perpendicular to the imprinted surface. This is the wheel turning system.

The second upper cylinders are mounted at the top of the side frame of the position identification system. Under the guidance of the second upper guide pillars, the second upper cylinders control the second upper platform to move up and down. The side cylinder and the side guide rails are mounted on the second upper platform, the side platform is mounted on the side guide rails, and the output end of the side cylinder is connected to the side platform. The feed cylinder is mounted on the side platform and controls the second feed platform to move up and down under the guidance of the second feed guide pillars, the paint supply tank is mounted on the second feed platform and the elastic pressure head is mounted at its output end. The height of the elastic pressure head can be adjusted under the aid of the second upper cylinders to be close to the front side of the wheel, and the horizontal position of the elastic pressure head can be adjusted via the side cylinder such that the elastic pressure head can imprint any radial position of the wheel, and cooperates with the position identification system and the wheel turning system to realize the imprinting of the wheel at any position in the radial direction and the circumferential direction, with strong flexibility. The feed imprinting of the elastic pressure head can be accomplished via the feed cylinder, and paint can be automatically replenished to the top of the elastic pressure head via the paint supply tank to ensure that the imprinted logo is clear. This is the logo imprinting system.

The first servo motor is mounted on the support frame and its output end is connected to the rotary table to control the rotation of the rotary table. The second servo motor and the third servo motor are symmetrically mounted on the rotary table at an angle of degrees. The output end of the second servo motor is connected to the first manipulator, and this is the left station for the imprinting of the wheel. The output end of the third servo motor is connected to the second manipulator, and this is the right station for the drying of the logo. During the initial operation, first, the manipulator at the left station clamps the wheel for imprinting, and the manipulator at the right station is idle. After the wheel at the left station is imprinted, the first servo motor is started to drive the rotary table to rotate degrees, the idle manipulator at the right station is switched to the left side for feeding and imprinting, and the manipulator clamping the wheel at the left station is switched to the right side for drying and discharging. When the device operates continuously, the wheel at the left station is fed and imprinted, and the wheel at the right station is dried and discharged at the same time. The processes are integrated through the double stations to greatly shorten the production cycle. This is the station switching system.

The third upper cylinder is mounted directly above the wheel at the right station. Under the guidance of the third upper guide pillars, the third upper cylinder controls the oven rack to move up and down. A plurality of oven heat sources are uniformly distributed on the oven rack to ensure a suitable temperature for drying the logo paint. The fourth upper cylinders are also fixed at the upper part of the frame. Under the guidance of the fourth upper guide pillars, the fourth upper cylinders control the shields to move up and down. The shields and the sleeves jointly form an oven outer wall for maintaining the temperature stability and guaranteeing quick drying of the logo paint. This is the logo drying system.

The second jacking cylinder is symmetrically mounted on the right side of the first jacking cylinder. Under the guidance of the discharge guide pillars, the second jacking cylinder controls the discharge platform to move up and down. When the logo of the wheel at the right station is dried, the second jacking cylinder is started to drive the discharge platform to ascend till the discharge platform contacts the flange surface of the wheel, the manipulator releases the wheel, the wheel falls onto the discharge platform, the second positioning column plays a role in radial stabilization, then, the second jacking cylinder returns and is reset, and the wheel falls into the logistics roller bed and continues to turn down. This is the wheel discharging system.

The operating process of the wheel logo imprinting device is as follows: first, after a wheel enters the roller bed, the clamping cylinder is started, the left sliding table and the right sliding table move synchronously under the action of the gear rack, and the four positioning wheels can initially position the wheel and then the four positioning wheels are reset; next, the first jacking cylinder is started to drive the first feed platform to ascend, the air pump is opened to provide compressed air to the flange surface of the wheel, the first positioning column is inserted into the center hole of the wheel when the first feed platform contacts the flange surface of the wheel, the air pump is closed, the first feed platform continues to ascend to jack the wheel to a predetermined height, the first manipulator above the wheel clamps the wheel via the four rollers, and the first feed platform is reset to complete feeding of the wheel; then the roller driven motors are started to drive the wheel to rotate at a low speed, a circumferential imprinting position can be accurately found by the detection of the visual identifier, then the wheel stops rotating, the elastic pressure head is adjusted to a predetermined radial position of the wheel via the side cylinder, the second servo motor controls the wheel to turn a certain angle such that the elastic pressure head is perpendicular to the imprinted surface, at this time, the circumferential and radial positions of an imprinted logo are determined, the elastic pressure head is perpendicular to the imprinted surface, and the logo is imprinted via the feed of the feed cylinder; next, the first servo motor is started to drive the rotary table to rotate degrees, the idle manipulator at the right station is switched to the left side for feeding and imprinting of a second wheel, the manipulator clamping the wheel at the left station is switched to the right side, the third upper cylinder and the fourth upper cylinders are started to drive the oven heat sources to begin drying near the front side of the wheel, and the shields preserve the heat; after the logo of the wheel at the right station is dried, the second jacking cylinder is started to drive the discharge platform to ascend till the discharge platform contacts the flange surface of the wheel, the manipulator releases the wheel, the wheel falls onto the discharge platform, then the second jacking cylinder returns and is reset, the wheel falls into the logistics roller bed, the logo imprinting of the first wheel is completed, at this time, the feeding and imprinting of the second wheel are completed, the first servo motor is started again to drive the rotary table to rotate degrees, the idle manipulator at the right station is switched to the left side for reloading next wheel, and the wheel clamped at the left station is switched to the right side and dried. So far, the device enters a continuous steady state, the wheel at the left station is fed and imprinted, the wheel at the right station is dried and discharged at the same time, and so on.

The device can be used for continuous production of assembly lines, can realize multi-directional, multi-angle and multi-number imprinting of personalized logos, orderly connects feeding, imprinting, drying and discharging through a reasonable process layout, and integrates imprinting and drying by using double stations so as to greatly improve the production efficiency and shorten the production cycle.

LIST OF REFERENCE SYMBOLS

Figure 1:
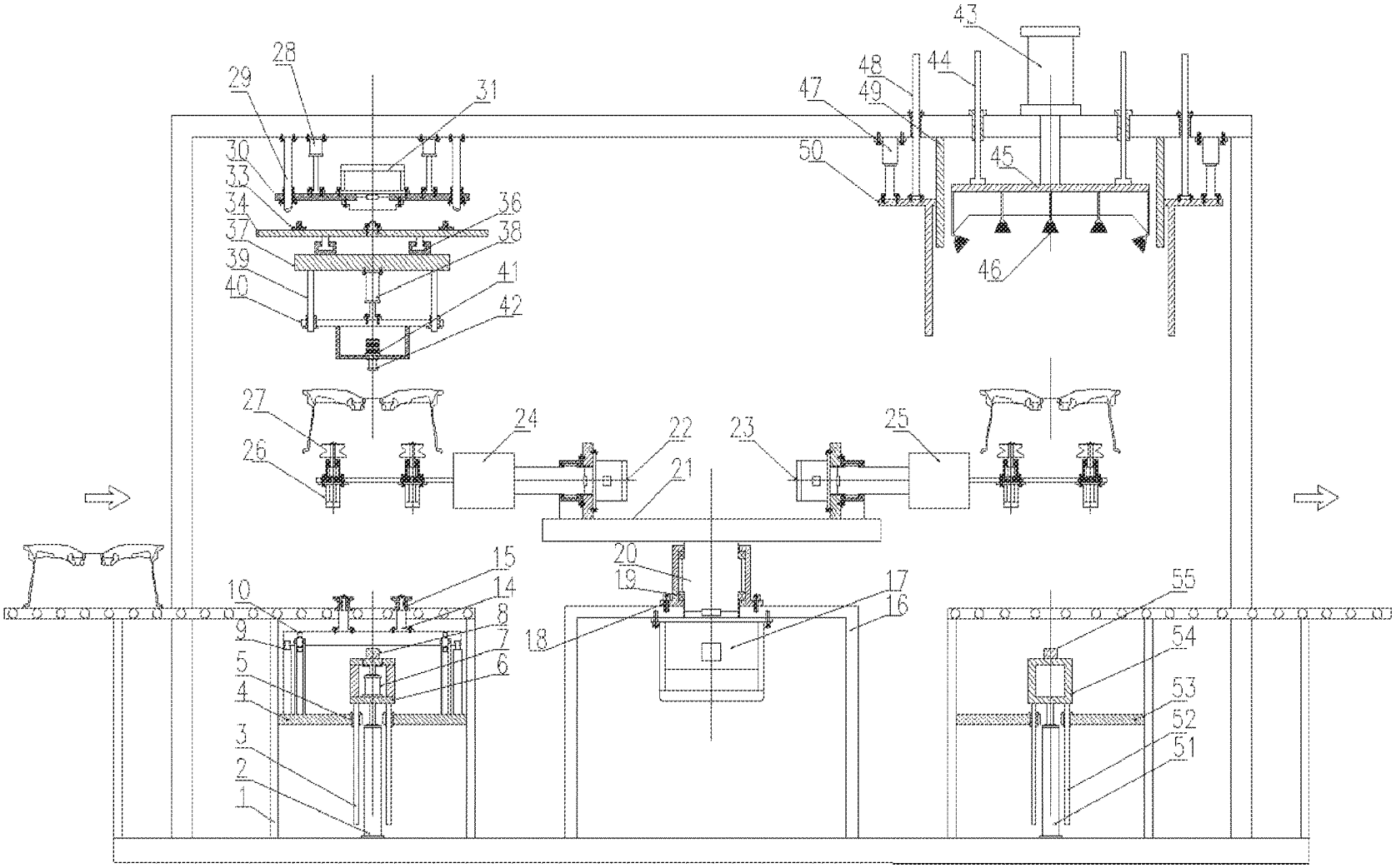
FIG. 1 is a front view of a wheel logo imprinting device according to the present disclosure.
Figure 2:
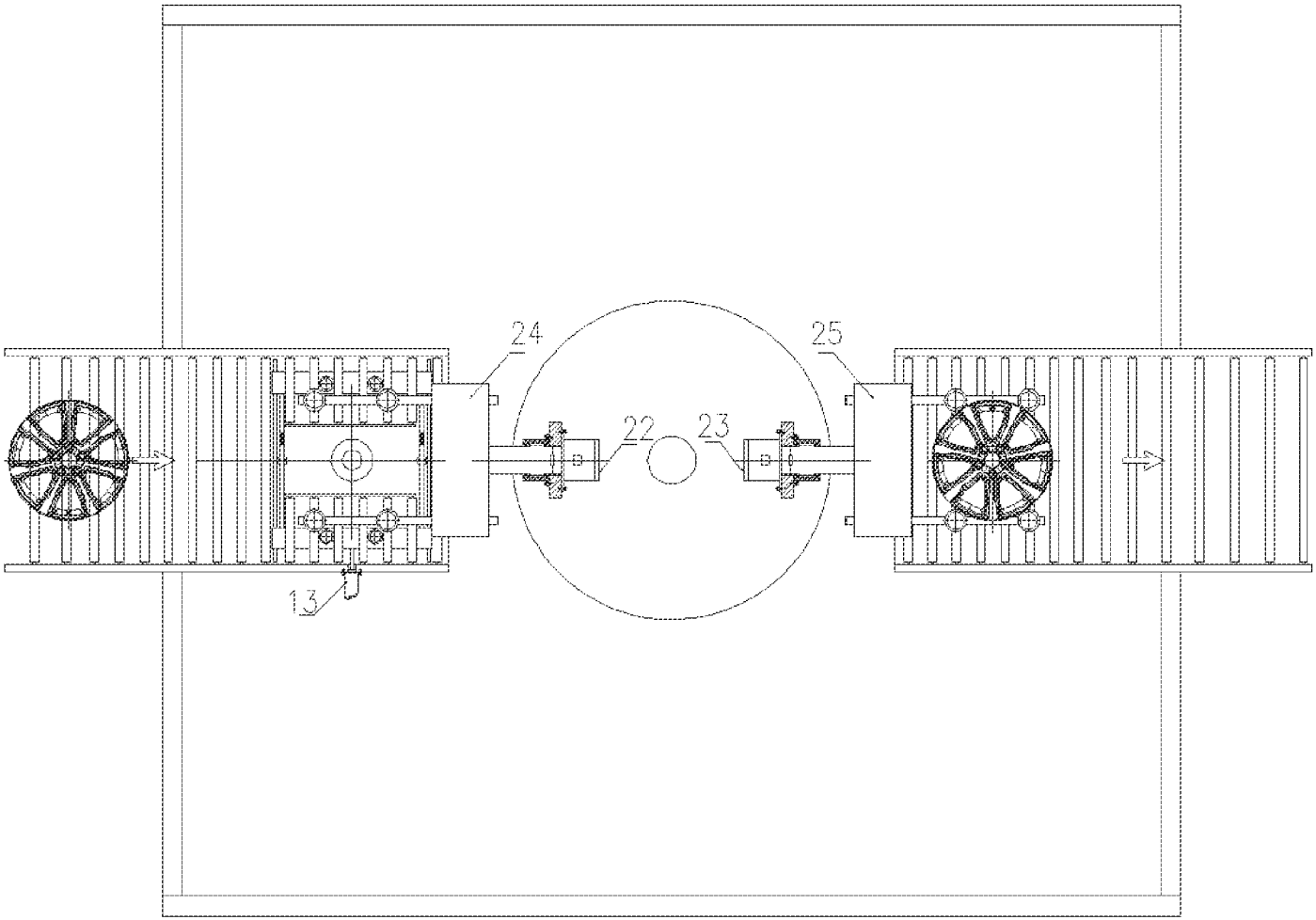
FIG. 2 is a top view of the wheel logo imprinting device according to the present disclosure.
Figure 3:
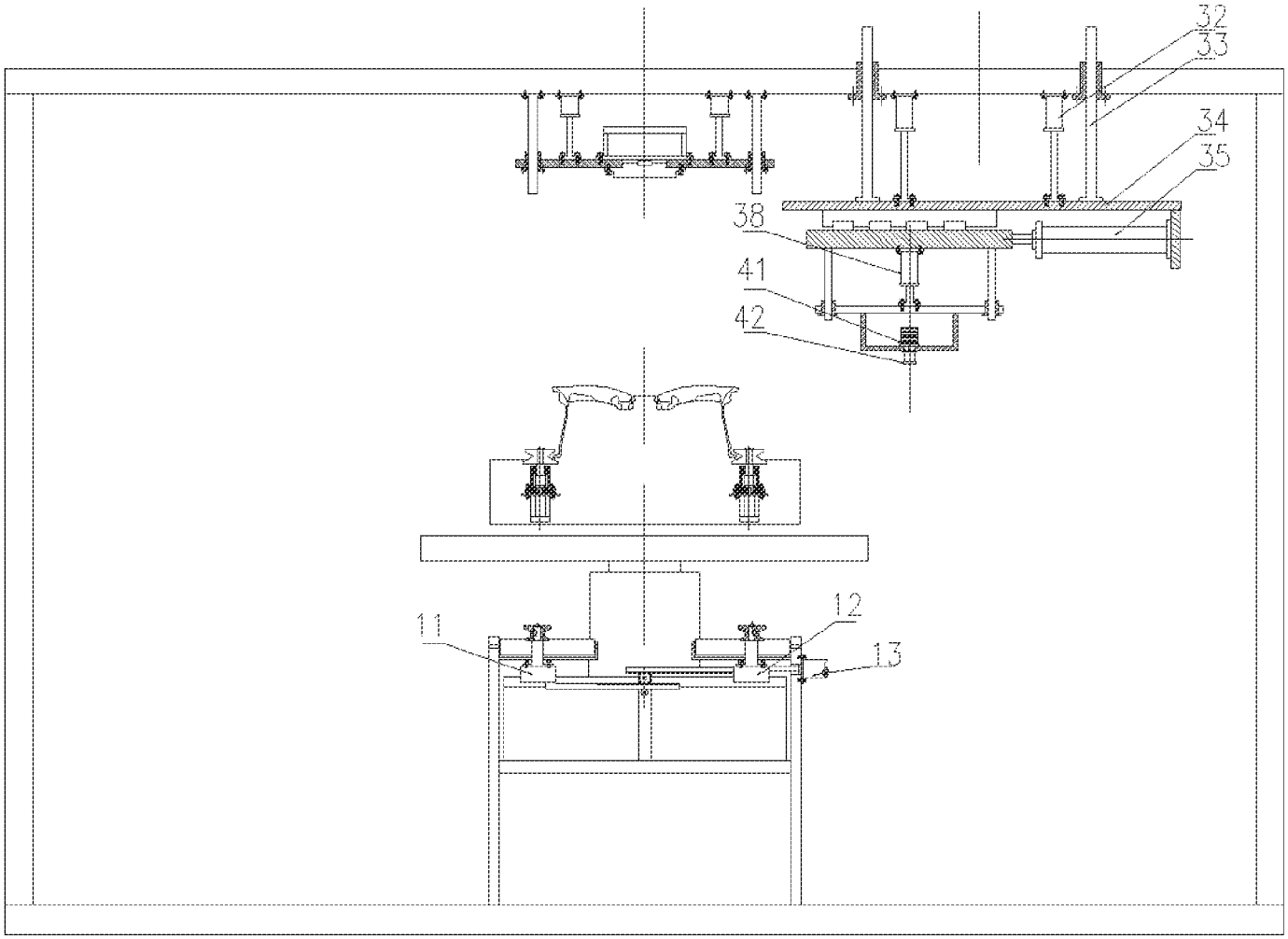
FIG. 3 is a left view of the wheel logo imprinting device according to the present disclosure.
Figure 4:
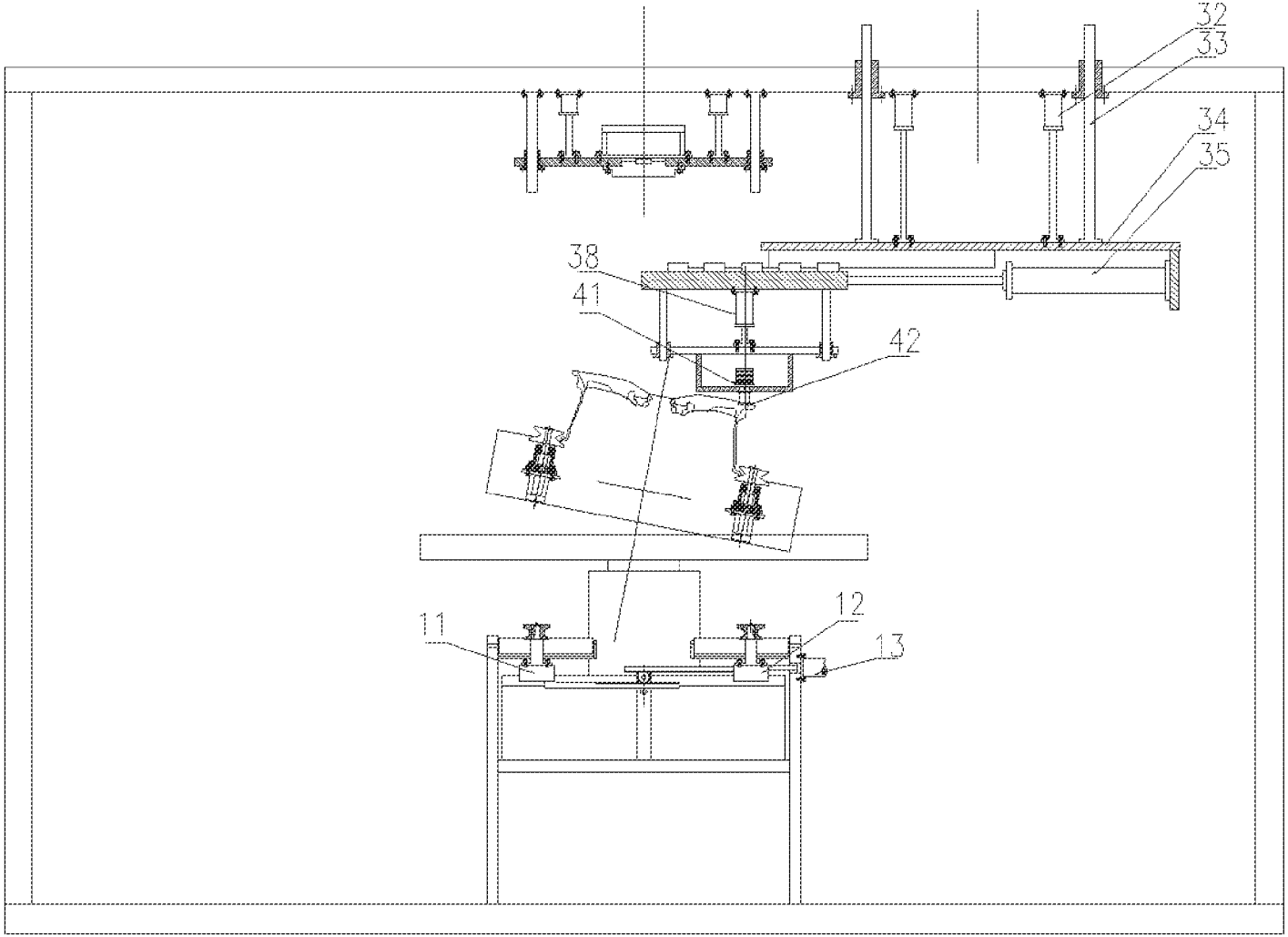
FIG. 4 is a left view when the wheel logo imprinting device imprints a logo according to the present disclosure.

1—frame, 2—first jacking cylinder, 3—first feed guide pillar, 4—first support frame, 5—guide sleeve, 6—first feed platform, 7—air pump, 8—first positioning column, 9—guide rail, 10—gear rack, 11—left sliding table, 12—right sliding table, 13—clamping cylinder, 14—positioning shaft, 15—positioning wheel, 16—support frame, 17—first servo motor, 18—bearing seat, 19—bearing, 20—shaft, 21—rotary table, 22—second servo motor, 23—third servo motor, 24—first manipulator, 25—second manipulator, 26—roller driven motor, 27—roller, 28—first upper cylinder, 29—first upper guide pillar, 30—first upper platform, 31—visual identifier, 32—second upper cylinder, 33—second upper guide pillar, 34—second upper platform, 35—side cylinder, 36—side guide rail, 37—side platform, 38—feed cylinder, 39—second feed guide pillar, 40—second feed platform, 41—paint supply tank, 42—elastic pressure head, 43—third upper cylinder, 44—third upper guide pillar, 45—oven rack, 46—oven heat source, 47—fourth upper cylinder, 48—fourth upper guide pillar, 49—sleeve, 50—shield, 51—second jacking cylinder, 52—discharge guide pillar, 53—second support frame, 54—discharge platform, 55—second positioning column.

DETAILED DESCRIPTION

The details and working conditions of the specific device proposed by the present disclosure will be described below in combination with the accompanying drawings.

A wheel logo imprinting device includes a frame 1, a first jacking cylinder 2, first feed guide pillars 3, a first support frame 4, a guide sleeve 5, a first feed platform 6, an air pump 7, a first positioning column 8, guide rails 9, a gear rack 10, a left sliding table 11, a right sliding table 12, a clamping cylinder 13, positioning shafts 14, positioning wheels 15, a support frame 16, a first servo motor 17, a bearing seat 18, a bearing 19, a shaft 20, a rotary table 21, a second servo motor 22, a third servo motor 23, a first manipulator 24, a second manipulator 25, roller driven motors 26, rollers 27, first upper cylinders 28, first upper guide pillars 29, a first upper platform 30, a visual identifier 31, second upper cylinders 32, second upper guide pillars 33, a second upper platform 34, a side cylinder 35, side guide rails 36, a side platform 37, a feed cylinder 38, second feed guide pillars 39, a second feed platform 40, a paint supply tank 41, an elastic pressure head 42, a third upper cylinder 43, third upper guide pillars 44, an oven rack 45, oven heat sources 46, fourth upper cylinders 47, fourth upper guide pillars 48, sleeves 49, shields 50, a second jacking cylinder 51, discharge guide pillars 52, a second support frame 53, a discharge platform 54 and a second positioning column 55.

The wheel logo imprinting device includes a wheel feeding system, a position identification system, a wheel turning system, a logo imprinting system, a station switching system, a logo drying system and a wheel discharging system. The respective systems coordinate to connect feeding, imprinting, drying and discharging of wheels orderly and reciprocally for continuous production.

The guide rails 9 are symmetrically mounted on the first support frame 4, the left sliding table 11 and the right sliding table 12 are symmetrically mounted on the guide rails 9 and connected by the gear rack 10, the output end of the clamping cylinder 13 is connected to the right sliding table 12, and the four positioning wheels 15 are mounted on the left sliding table 11 and the right sliding table 12 via the positioning shafts 14. The output end of the first jacking cylinder 2 is connected to the first feed platform 6. Under the guidance of the first feed guide pillars 3, the first jacking cylinder 2 controls the first feed platform 6 to move up and down. The first positioning column 8 is mounted on the upper end surface of the first feed platform 6 to prevent a wheel from deviating during ascending, the air pump 7 is mounted inside the first feed platform 6 to output compressed air, and the compressed air is blown out from the upper end surface of the first feed platform 6 to dry the flange surface of the wheel so as to improve the positioning stability of the wheel. After the wheel enters a roller bed, the clamping cylinder 13 is started, the left sliding table 11 and the right sliding table 12 move synchronously under the action of the gear rack 10, the wheel can be initially positioned by the four positioning wheels 15, and then the positioning wheels 15 are reset; next, the first jacking cylinder 2 is started to drive the first feed platform 6 to ascend, and the air pump 7 is opened to provide compressed air to the flange surface of the wheel; when the first feed platform 6 contacts the flange surface of the wheel, the first positioning column 8 is inserted into the center hole of the wheel, the air pump 7 is closed, the first feed platform 6 continues to ascend to jack the wheel to a predetermined height, the first manipulator 24 located above the wheel can clamp the wheel through the four rollers 27, and then the first feed platform 6 is re reset. This is the wheel feeding system, and the wheel is conveyed from the roller bed to be clamped by the manipulator.

The first upper cylinders 28 are fixedly mounted on the frame directly above the wheel and controls the first upper platform 30 to move up and down under the guidance of the first upper guide pillars 29, the visual identifier 31 is mounted on the first upper platform 30, and the first upper cylinders 28 drive the first upper platform 30 to move up and down to adjust the visual detection accuracy of the visual identifier 31. After the manipulator clamps the wheel, the roller driven motors 26 can drive the rollers 27 to rotate so as to drive the wheel to rotate at a low speed, and an imprinting position in the circumferential direction can be accurately found by the detection of the visual identifier 31. After the imprinting position is found, the wheel stops rotating. After one logo is imprinted, the imprinting system is retracted, the wheel can continue to rotate, and next imprinting position is searched through the visual identifier 31, thereby realizing multi-position and multi-number imprinting of personalized logos in the circumferential direction of the wheel. This is the position identification system.

The second servo motor 22 is fixed on the rotary table 21, and its output end is connected to the first manipulator 24 to control the turning of the manipulator, thereby controlling the turning of the wheel. The front spokes, rim and window of the wheel have certain arc angles. When a logo is imprinted, the elastic pressure head 42 needs to be perpendicular to the imprinted surface, so the wheel needs to be turned over. The second servo motor 22 can control the wheel to turn over at any angle, so that the elastic pressure head 42 is perpendicular to the imprinted surface. This is the wheel turning system.

The second upper cylinders 32 are mounted at the top of the side frame of the position identification system. Under the guidance of the second upper guide pillars 33, the second upper cylinders 32 control the second upper platform 34 to move up and down. The side cylinder 35 and the side guide rails 36 are mounted on the second upper platform 34, the side platform 37 is mounted on the side guide rails 36, and the output end of the side cylinder 35 is connected to the side platform 37. The feed cylinder 38 is mounted on the side platform 37 and controls the second feed platform 40 to move up and down under the guidance of the second feed guide pillars 39, the paint supply tank 41 is mounted on the second feed platform 40 and the elastic pressure head 42 is mounted at its output end. The height of the elastic pressure head 42 can be adjusted under the aid of the second upper cylinders 32 to be close to the front side of the wheel, and the horizontal position of the elastic pressure head 42 can be adjusted via the side cylinder 35 such that the elastic pressure head 42 can imprint any radial position of the wheel, and cooperates with the position identification system and the wheel turning system to realize the imprinting of the wheel at any position in the radial direction and the circumferential direction, with strong flexibility. The feed imprinting of the elastic pressure head 42 can be accomplished via the feed cylinder 38, and paint can be automatically replenished to the top of the elastic pressure head 42 via the paint supply tank 41 to ensure that the imprinted logo is clear. This is the logo imprinting system.

The first servo motor 17 is mounted on the support frame 16 and its output end is connected to the rotary table 21 to control the rotation of the rotary table 21. The second servo motor 22 and the third servo motor 23 are symmetrically mounted on the rotary table at an angle of 180 degrees. The output end of the second servo motor 22 is connected to the first manipulator 24, and this is the left station for the imprinting of the wheel. The output end of the third servo motor 23 is connected to the second manipulator 25, and this is the right station for the drying of the logo. During the initial operation, first, the manipulator at the left station clamps the wheel for imprinting, and the manipulator at the right station is idle. After the wheel at the left station is imprinted, the first servo motor 17 is started to drive the rotary table 21 to rotate 180 degrees, the idle manipulator at the right station is switched to the left side for feeding and imprinting, and the manipulator clamping the wheel at the left station is switched to the right side for drying and discharging. When the device operates continuously, the wheel at the left station is fed and imprinted, and the wheel at the right station is dried and discharged at the same time. The processes are integrated through the double stations to greatly shorten the production cycle. This is the station switching system.

The third upper cylinder 43 is mounted directly above the wheel at the right station. Under the guidance of the third upper guide pillars 44, the third upper cylinder 43 controls the oven rack 45 to move up and down. A plurality of oven heat sources 46 are uniformly distributed on the oven rack 45 to ensure a suitable temperature for drying the logo paint. The fourth upper cylinders 47 are also fixed at the upper part of the frame. Under the guidance of the fourth upper guide pillars 48, the fourth upper cylinders 47 control the shields 50 to move up and down. The shields 50 and the sleeves 49 jointly form an oven outer wall for maintaining the temperature stability and guaranteeing quick drying of the logo paint. This is the logo drying system.

The second jacking cylinder 51 is symmetrically mounted on the right side of the first jacking cylinder 2. Under the guidance of the discharge guide pillars 52, the second jacking cylinder 51 controls the discharge platform 54 to move up and down. When the logo of the wheel at the right station is dried, the second jacking cylinder 51 is started to drive the discharge platform 54 to ascend till the discharge platform 54 contacts the flange surface of the wheel, the manipulator releases the wheel, the wheel falls onto the discharge platform 54, the second positioning column 55 plays a role in radial stabilization, then, the second jacking cylinder 51 returns and is reset, and the wheel falls into the logistics roller bed and continues to turn down. This is the wheel discharging system.

The operating process of the wheel logo imprinting device is as follows: first, after a wheel enters the roller bed, the clamping cylinder 13 is started, the left sliding table 11 and the right sliding table 12 move synchronously under the action of the gear rack 10, and the four positioning wheels 15 can initially position the wheel and then the four positioning wheels 15 are reset; next, the first jacking cylinder 2 is started to drive the first feed platform 6 to ascend, the air pump 7 is opened to provide compressed air to the flange surface of the wheel, the first positioning column 8 is inserted into the center hole of the wheel when the first feed platform 6 contacts the flange surface of the wheel, the air pump 7 is closed, the first feed platform 6 continues to ascend to jack the wheel to a predetermined height, the first manipulator 24 above the wheel clamps the wheel via the four rollers 27, and the first feed platform 6 is reset to complete feeding of the wheel; then the roller driven motors 26 are started to drive the wheel to rotate at a low speed, a circumferential imprinting position can be accurately found by the detection of the visual identifier 31, then the wheel stops rotating, the elastic pressure head 42 is adjusted to a predetermined radial position of the wheel via the side cylinder 35, the second servo motor 22 controls the wheel to turn a certain angle such that the elastic pressure head 42 is perpendicular to the imprinted surface, at this time, the circumferential and radial positions of an imprinted logo are determined, the elastic pressure head is perpendicular to the imprinted surface, and the logo is imprinted via the feed of the feed cylinder 38; next, the first servo motor 17 is started to drive the rotary table 21 to rotate 180 degrees, the idle manipulator at the right station is switched to the left side for feeding and imprinting of a second wheel, the manipulator clamping the wheel at the left station is switched to the right side, the third upper cylinder 43 and the fourth upper cylinders 47 are started to drive the oven heat sources 46 to begin drying near the front side of the wheel, and the shields 50 preserve the heat; after the logo of the wheel at the right station is dried, the second jacking cylinder 51 is started to drive the discharge platform 54 to ascend till the discharge platform 54 contacts the flange surface of the wheel, the manipulator releases the wheel, the wheel falls onto the discharge platform 54, then the second jacking cylinder 51 returns and is reset, the wheel falls into the logistics roller bed, the logo imprinting of the first wheel is completed, at this time, the feeding and imprinting of the second wheel are completed, the first servo motor 17 is started again to drive the rotary table 21 to rotate 180 degrees, the idle manipulator at the right station is switched to the left side for reloading next wheel, and the wheel clamped at the left station is switched to the right side and dried. So far, the device enters a continuous steady state, the wheel at the left station is fed and imprinted, the wheel at the right station is dried and discharged at the same time, and so on.

The device can be used for continuous production of assembly lines, can realize multi-directional, multi-angle and multi-number imprinting of personalized logos, orderly connects feeding, imprinting, drying and discharging through a reasonable process layout, and integrates imprinting and drying by using double stations so as to greatly improve the production efficiency and shorten the production cycle.

The invention claimed is:

1. A wheel logo imprinting device, comprising a frame, a first jacking cylinder, first feed guide pillars, a first support frame, a first feed platform, an air pump, a first positioning column, guide rails, a gear rack, a left sliding table, a right sliding table, a clamping cylinder, positioning shafts, positioning wheels, a support, a first servo motor, a rotary table, a second servo motor, a third servo motor, a first manipulator, a second manipulator, roller driven motors, rollers, first upper cylinders, first upper guide pillars, a first upper platform, a visual identifier, second upper cylinders, second upper guide pillars, a second upper platform, a side cylinder side guide rails, a side platform, a feed cylinder, second feed guide pillars, a second feed platform, a paint supply tank, an elastic pressure head, a third upper cylinder, third upper guide pillars, an oven rack, oven heat sources, fourth upper cylinders, fourth upper guide pillars, sleeves, shields, a second jacking cylinder, discharge guide pillars, and a discharge platform, wherein the guide rails are symmetrically mounted on the first support frame, the left sliding table and the right sliding table are symmetrically mounted on the guide rails and connected with one another by the gear rack, the clamping cylinder is connected to the right sliding table, each of the positioning wheels is mounted on a respective one of the left sliding table and the right sliding table via a respective one of the positioning shafts, the first jacking cylinder is connected to the first feed platform and controls the first feed platform under a guidance of the first feed guide pillars, the first positioning column is mounted on an upper end surface of the first feed platform, the air pump is mounted inside the first feed platform, the first upper cylinders are fixedly mounted on the frame and control the first upper platform to move under a guidance of the first upper guide pillars, the second servo motor is fixed on the rotary table and connected to the first manipulator, the side cylinder and the side guide rails are mounted on the second upper platform, the second upper cylinders control the second upper platform to move under a guidance of the second upper guide pillars, the side platform is mounted on the side guide rails, the side cylinder is connected to the side platform, the feed cylinder is mounted on the side platform and controls the second feed platform to move under a guidance of the second feed guide pillars, the paint supply tank is mounted on the second feed platform and the elastic pressure head is mounted at an output end of the paint supply tank, the first servo motor is mounted on the support and an output end of the first servo motor is connected to the rotary table, the second servo motor and the third servo motor are symmetrically mounted on the rotary table, an output end of the second servo motor is connected to the first manipulator to form a left station for imprinting of a wheel, an output end of the third servo motor is connected to the second manipulator to form a right station for drying of a logo, the third upper cylinder is mounted directly above the wheel at the right station, the third upper cylinder controls the oven rack to move under a guidance of the third upper guide pillars, the oven heat sources are uniformly distributed on the oven rack, the fourth upper cylinders are fixed at an upper part of the frame, the fourth upper cylinders control the shields to move under a guidance of the fourth upper guide pillars, the shields and the sleeves jointly form an oven outer wall, the second jacking cylinder is mounted on a right side of the first jacking cylinder, the second jacking cylinder controls the discharge platform to move under a guidance of the discharge guide pillars, wherein the visual identifier is mounted on the first upper platform, and the first upper cylinders drive the first upper platform to move up and down to adjust a visual detection accuracy of the visual identifier; the roller driven motors are configured to drive the rollers to rotate so as to drive the wheel to rotate, and an imprinting position in a circumferential direction is configured to be found by detection of the visual identifier.

* * * * *